US009256162B2

(12) United States Patent
Campbell et al.

(10) Patent No.: US 9,256,162 B2
(45) Date of Patent: Feb. 9, 2016

(54) METHOD AND APPARATUS FOR MAGNETIC BRUSH RETRACTION IN ELECTROPHOTOGRAPHIC SYSTEM

(71) Applicant: Lexmark International, Inc., Lexington, KY (US)

(72) Inventors: Alan Stirling Campbell, Lexington, KY (US); Gary Allen Denton, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 15 days.

(21) Appl. No.: 14/021,322

(22) Filed: Sep. 9, 2013

(65) Prior Publication Data

US 2015/0071686 A1 Mar. 12, 2015

(51) Int. Cl.
*G03G 15/09* (2006.01)

(52) U.S. Cl.
CPC ..... *G03G 15/0921* (2013.01)

(58) Field of Classification Search
CPC ..... G03G 15/0921
USPC ..... 399/276, 277
See application file for complete search history.

(56) References Cited

U.S. PATENT DOCUMENTS

2002/0122677 A1* 9/2002 Noda et al. ..... 399/277

* cited by examiner

*Primary Examiner* — David Gray
*Assistant Examiner* — Michael Harrison

(57) ABSTRACT

A method and apparatus for retracting a magnetic brush in an imaging device. The apparatus includes a housing containing carrier beads and toner particles; a magnetic structure at least partly disposed within the housing and generating at least one magnetic field; and an endless sleeve disposed around and rotatable about the magnetic structure, at least a portion of the sleeve extending from the housing. During toner development, the magnetic structure is in a first position for developing a magnetic brush of the carrier beads and toner particles along the portion of the sleeve extending from the housing which forms a developer nip with a photoconductor, and during a period of time when toner development is not to be performed, the magnetic structure is in a second position for retracting the magnetic brush by causing the carrier beads to be positioned against the portion of the endless sleeve extending from the housing forming the developer nip.

16 Claims, 3 Drawing Sheets

METHOD AND APPARATUS FOR MAGNETIC BRUSH RETRACTION IN ELECTROPHOTOGRAPHIC SYSTEM

CROSS REFERENCES TO RELATED APPLICATIONS

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Disclosure

The present disclosure relates generally to developing a magnetic brush for transferring toner to a photoconductive member, and particularly to selectively retracting the developed magnetic brush from contact with the photoconductor to substantially prevent background toner development.

2. Description of the Related Art

Electrophotography selectively develops toner to the photoconductor by discharging areas of the photoconductor that correspond to areas to be colored and leaving other areas charged so as to prevent toner development in those "white" areas. For negatively charged toner, these white areas are created by providing a photoconductor charge that is more negative than the developer bias. This difference between the photoconductor and developer biases is called the "white vector." If the white vector is too small, then mechanical development takes place resulting in a haze of toner on areas of the photoconductor that should be white. Increasing the white vector produces a reduction in toner to the white areas, but if the white vector is increased too much there is another increase in toner developed into the white areas. This increased development is the result of high electric field strengths that can result in modifications to the toner charge. The white vector is adjusted to its desired value when the least amount of toner is developed into the white or background areas of the photoconductor. Toner developed into these white areas is called "background toner" and is wasted toner. This toner waste reduces the useful life of a toner cartridge since it represents an undesirable draw of toner for printing.

A typical laser printer will create an image on the page with approximately 0.4 mg/cm$^2$ of print. Background toner with an appropriately adjusted white vector can be about 0.001 mg/cm$^2$. This may seem like an insignificant amount of waste toner, but since the areas of unprinted "white" are typically orders of magnitude larger than the printed areas, this waste toner has greater significance. For color laser printers, the cost to the customer of background toner when printing a white page can, in some circumstances, approach or exceed the cost of a sheet of paper. Most laser printers use white vector to limit development of background toner when the machine is running but not actually developing toner that goes to the printed page. White vector is an effective way to keep the white areas of prints white, but an improved method is needed to prevent toner waste when not printing.

SUMMARY

Example embodiments disclosed herein improve upon the shortcomings of existing dual component electrophotographic imaging devices and satisfy a significant need for reducing or otherwise eliminating background toner development. According to an example embodiment, there is shown a developer apparatus for an imaging system, including a housing containing a mixture of carrier beads and toner particles; a magnetic structure at least partly disposed within the housing and generating at least one magnetic field; and an endless sleeve disposed around and rotatable about the magnetic structure and extending from the housing. A portion of the endless sleeve extending from the housing forms a developer nip when the developer apparatus is operably coupled to an adjacent photoconductor. Toner is triboelectrically attracted to the surface of the carrier beads and the magnetic properties of the beads cause the beads to form structures called bead chains that are aligned with the direction of the magnetic field in their vicinity. During a printing operation in which toner is to be developed, the magnetic structure is in a first orientation for causing bead chains to "stand up" and extend outwardly from the portion of the endless sleeve, thereby forming a magnetic brush of the carrier beads and toner particles along the portion of the sleeve, for contacting with an adjacent photoconductor of the imaging system. However, during a period of time when toner development is not to be performed, the magnetic structure is in a second orientation which causes the bead chains to "lay down" and be positioned along the surface of the portion of the endless sleeve so as to be spaced apart from the adjacent photoconductor. As a result, toner particles are not positioned to contact the adjacent photoconductive member of the imaging system to be transferred thereto during times when toner development is not being performed.

In an example embodiment, the magnetic structure is rotated between the first and second positions by a motor, solenoid or the like. In another example embodiment, the magnetic structure is substantially freely rotatable about a shaft and is coupled to the endless sleeve via attractive forces with the carrier beads on the sleeve such that the magnetic structure rotates with the endless sleeve between the first and second positions. In this embodiment, the developer apparatus further includes an extension member having a first end connected to the shaft and a distal end. The extension member rotates with the shaft and thereby with the magnetic structure. The developer apparatus further includes a pair of stop members extending from or within the housing in proximity to the distal end of the extension member. The stop members are positioned to contact the distal end of the extension member and thereby serve to limit the amount of rotation of the magnetic structure to be between the first and second positions when the magnetic structure moves with the endless sleeve.

In yet another example embodiment, the magnetic structure is fixed. Following completion of toner development during a printing operation, the endless sleeve is rotated in a direction opposite to the direction of rotation during toner development, until the portion of the endless sleeve has little to no beads and toner particles that are disposed adjacent the photoconductive member.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings, wherein.

DETAILED DESCRIPTION

Figure 1:
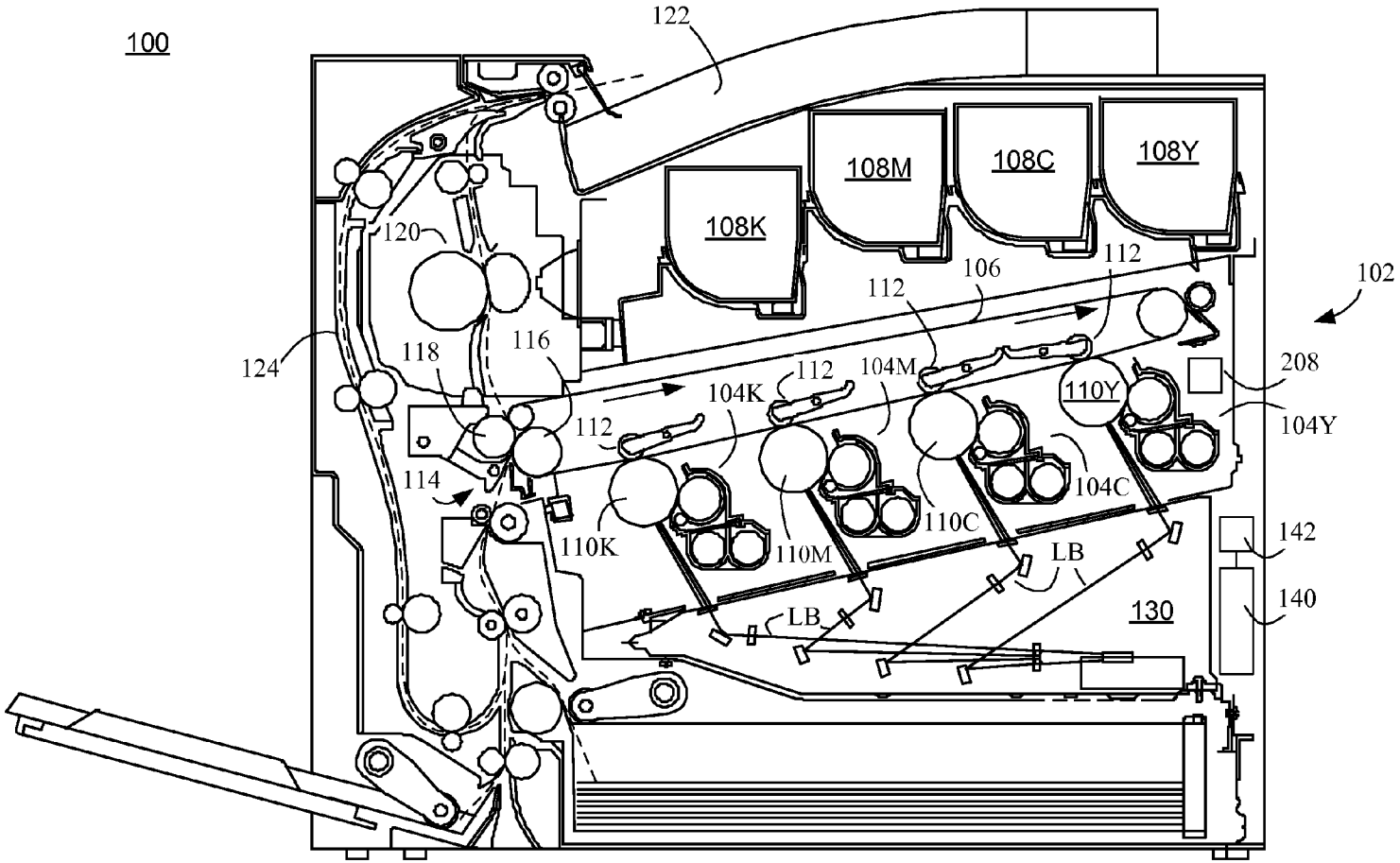
FIG. 1 is a side elevational view of an improved imaging device according to an example embodiment.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

FIG. 1 illustrates a color image forming device 100 according to an example embodiment. Image forming device 100 includes a first toner transfer area 102 having four developer units 104 that substantially extend from one end of image forming device 100 to an opposed end thereof. Developer units 104 are disposed along an intermediate transfer member (ITM) 106. Each developer unit 104 holds a different color toner mixed with carrier beads. The developer units 104 may be aligned in order relative to the direction of the ITM 106 indicated by the arrows in FIG. 1, with the yellow developer unit 104Y being the most upstream, followed by cyan developer unit 104C, magenta developer unit 104M, and black developer unit 104K being the most downstream along ITM 106.

Each developer unit 104 is operably connected to a toner reservoir 108 for receiving toner for use in a printing operation. Each toner reservoir 108K, 108M, 108C and 108Y is controlled to supply toner as needed to its corresponding developer unit 104. Each developer unit 104 is associated with a distinct photoconductive member 110 that receives toner therefrom during toner development to form a toned image thereon. Each photoconductive member 110 is paired with a transfer member 112 for use in transferring toner to ITM 106 at first transfer area 102.

During color image formation, the surface of each photoconductive member 110 is charged to a specified voltage. At least one laser beam LB from a printhead 130 is directed to the surface of each photoconductive member 110 and discharges those areas it contacts to form a latent image thereon. The developer unit 104 then supplies toner to photoconductive member 110 to form a toner image thereon. The toner is attracted to the areas of the surface of photoconductive member 110 that are discharged by the corresponding laser beam LB from the printhead 130.

ITM 106 is disposed adjacent to each developer unit 104. In this embodiment, ITM 106 is formed as an endless belt disposed about a drive roller and other rollers. During image forming operations, ITM 106 moves past photoconductive members 110 in a clockwise direction as viewed in FIG. 1. One or more of photoconductive members 110 applies its toner image in its respective color to ITM 106. For monochrome images, a toner image is applied from a single photoconductive member 110K. For multi-color images, toner images are applied from two or more photoconductive members 110. In one embodiment, a positive voltage field formed in part by transfer member 112 attracts the toner image from the associated photoconductive member 110 to the surface of a moving ITM 106.

ITM 106 rotates and collects the one or more toner images from the one or more developer units 104 and then conveys the one or more toner images to a media sheet at a second transfer area 114. Second transfer area 114 includes a second transfer nip formed between at least one back-up roller 116 and a second transfer roller 118.

Fuser assembly 120 is disposed downstream of second transfer area 114 and receives media sheets with the unfused toner images superposed thereon. In general terms, fuser assembly 120 applies heat and pressure to the media sheets in order to fuse toner thereto. After leaving fuser assembly 120, a media sheet is either deposited into output media area 122 or enters duplex media path 124 for transport to second transfer area 114 for imaging on a second surface of the media sheet.

Image forming device 100 is depicted in FIG. 1 as a color laser printer in which toner is transferred to a media sheet in a two step operation. Alternatively, image forming device 100 may be a color laser printer in which toner is transferred to a media sheet in a single step process—from photoconductive members 110 directly to a media sheet. In another alternative embodiment, image forming device 100 may be a monochrome laser printer which utilizes only a single developer unit 104 and photoconductive member 110 for depositing black toner to media sheets. Further, image forming device 100 may be part of a multi-function product having, among other things, an image scanner for scanning printed sheets.

Image forming device 100 further includes a controller 140 and memory 142 communicatively coupled thereto. Though not shown in FIG. 1, controller 140 may be coupled to components and modules in image forming device 100 for controlling same. For instance, controller 140 may be coupled to toner reservoirs 108, developer units 104, photoconductive members 110, fuser 120 and/or printhead 130. It is understood that controller 140 may be implemented as any number of controllers and/or processors for suitably controlling image forming device 100 to perform, among other functions, printing operations.

The toner in developer unit 104 is charged to an appropriate amount to facilitate the correct amount of development on the surface of photoconductive member 110. A dual component development system includes a developer mix containing a portion of polymeric resin based toner, and magnetic carrier beads. Typically the magnetic carrier beads will have a polymeric coating constructed of a triboelectrically different resin than the toner. When the toner is mixed with the carrier, the toner will charge to one polarity, while the carrier coating will charge to the opposite polarity. At this point, the toner will adhere to the oppositely charged carrier beads. In the example embodiments described herein, image forming device 100 utilizes a dual component development system.

Figure 2:
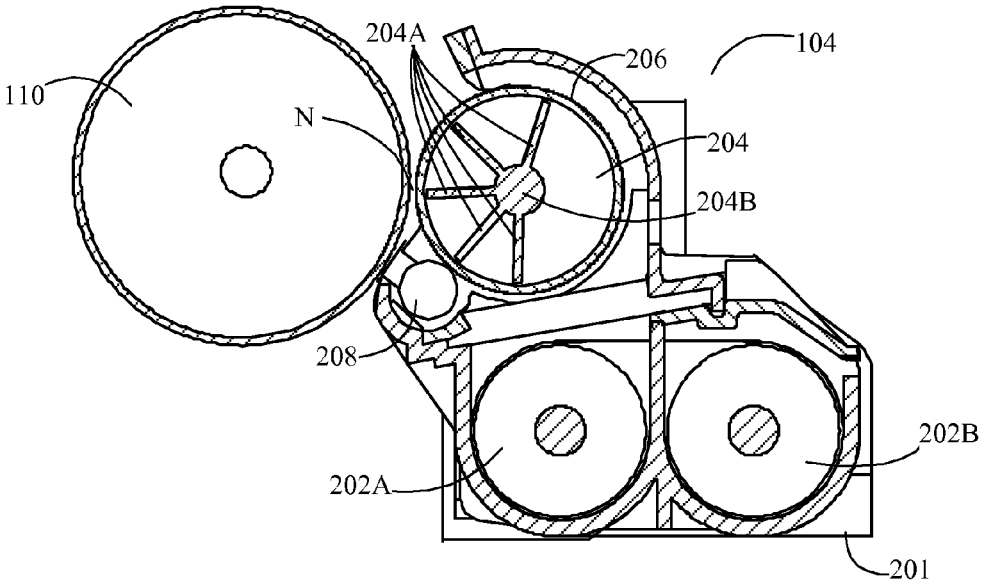
FIG. 2 is a cross sectional view of the developer unit of FIG. 1 according to an example embodiment.
Figure 3:
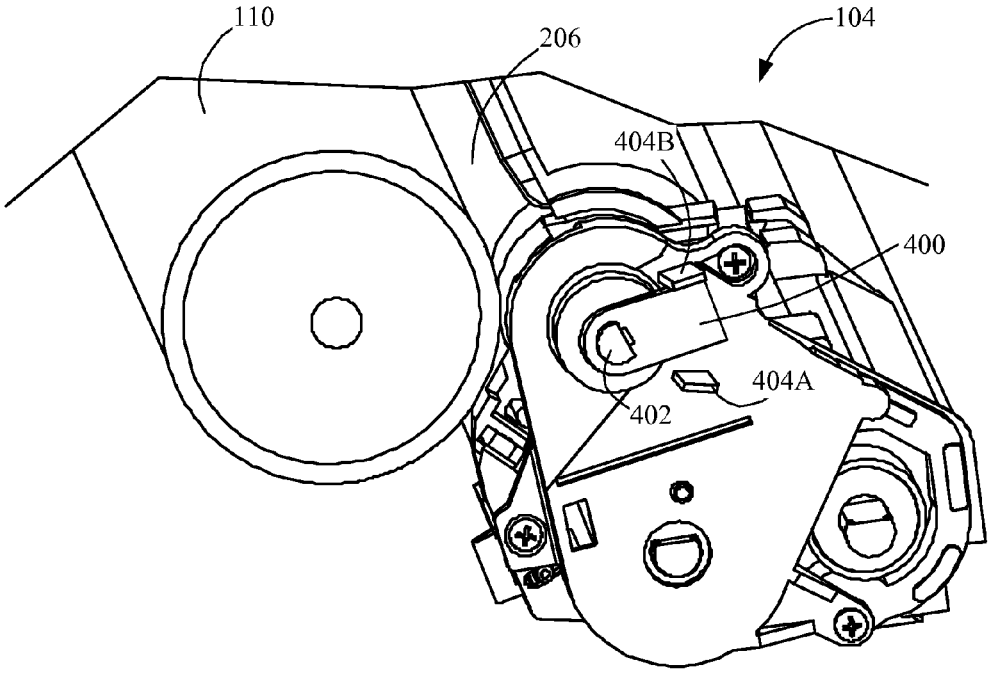
FIG. 3 is a perspective view of an end portion of a portion of the developer unit of FIG. 2.

FIGS. 2 and 3 illustrate a developer unit 104 in association with a corresponding photoconductive member 110. Developer unit 104 includes a housing 201 having a chamber in which toner, deposited from a toner reservoir 108, is mixed with the carrier beads. In an example embodiment, dual augers 202 are used to mix the toner and carrier beads. In this embodiment, a first auger 202A may be used to mix toner and carrier beads by moving them in a first direction and a second auger 202B may be used to mix the toner and beads by moving them in the direction opposite to the first direction. It is understood that developer unit 104 may utilized other mechanisms for suitably mixing the toner and carrier beads.

Developer unit 104 may further include a magnetic structure 204 and an endless sleeve 206 which is disposed about magnetic structure 204. Magnetic structure 204 generally serves to attract the mixture of toner and carrier beads onto endless sleeve 206 due to magnetic forces acting on the carrier beads. Magnetic structure 204 may be constructed from a permanent magnetic material containing ferrite, and magnetized to produce a multiplicity of magnetic poles 204A positioned around magnetic structure 204. Magnetic poles 204A are spaced apart from each other to control the strength and direction of the magnetic field outside the surface of endless sleeve 206, and to thereby direct the formation of bead chains at different stages of the development process. Magnetic structure 204 may further include a shaft (not shown in FIG. 2) extending longitudinally therethrough.

As shown in FIG. 2, a portion of each of magnetic structure 204 and sleeve 206 extends from an opening in housing 201 so as to be positioned adjacent photoconductive member 110. Sleeve 206 may be constructed from a non-magnetic material such as aluminum or the like. Sleeve 206 may be substantially entirely disposed about magnetic structure 204. In an example embodiment, sleeve 206 is rotatable about magnetic structure 204. A motor 208 (FIG. 1) may be coupled to rotate sleeve 206 about magnetic structure 204 as controlled by controller 140. Motor 208 may be mechanically coupled to sleeve 206 using coupling mechanisms known in the art. In an example embodiment, sleeve 206 of each developer unit 104 may be controlled by a distinct motor 208. Alternatively, a single motor 208 may be coupled to and rotate sleeve 206 of more than one developer unit 104.

During toner development, sleeve 206 is rotated in a forward direction (clockwise as shown in FIG. 2) so that carrier beads having toner particles adhered thereto cling to sleeve 206 due to magnetic forces acting on the carrier beads from magnetic structure 204. As sleeve 206 is rotated relative to magnetic structure 204 and the magnetic forces generated thereby, the magnetic carrier bead chains move in an alternating manner from substantially laying down and disposed against sleeve 206 to standing up and extending outwardly therefrom so as to form a magnetic brush. A trim bar 210 regulates the length of the outwardly extending carrier chains on sleeve 206. When sleeve 206 is further rotated so that the carrier beads are in the developer nip N adjacent photoconductive member 110, the carrier beads again form chains extending outwardly from sleeve 206. As the carrier chains forming the magnetic brush make contact with photoconductive member 110 in developer nip N, toner particles detach from their carrier beads due to the charge of the latent image on photoconductive member 100 and move to the discharged areas of photoconductive member 110. Continued clockwise rotation of sleeve 206 results in the carrier beads separating from sleeve 206 due to a reduction in magnetic forces from magnetic structure 204 acting on the carrier beads. The separated carrier beads are then mixed with toner by augers 202 to begin again the toner development process.

Example embodiments provide a reduction in background toner development without carrier bead loss. Background toner development is reduced by any of a number of mechanisms. In an example embodiment, magnetic structure 204 is rotated in a reverse direction during times when toner development is not to occur so that the carrier chains at developer nip N are disposed substantially against and/or tangent to sleeve 206 instead of being arranged in chains of carrier beads extending outwardly therefrom. The amount of rotation of magnetic structure 204 may be between about 20 degrees and about 40 degrees, such as about 30 degrees. Without the presence of erect, outwardly extending carrier chains in developer nip N to contact photoconductive member 110, toner is unable to move thereto. In this way, there are two angular orientations or positions of magnetic structure 204—a first angular orientation in which magnetic structure 204 is positioned to cause chains of carrier beads to extend outwardly from sleeve 206 in developer nip N during times when toner is to be developed, and a second angular orientation in which magnetic structure 204 is positioned to cause the carrier beads to lie substantially flat against sleeve 206 in developer nip N when toner development is not desired to occur.

The rotation of magnetic structure 204 may be effectuated by a motor, solenoid or the like so as to rotate magnetic structure 204 between the first and second angular orientations. In this embodiment, controller 140 may control the motor for rotating magnetic structure 204 to the first angular orientation during toner development and to the second angular orientation at times when toner development is not intended to occur. Alternatively, magnetic structure 204 is configured to freely rotate only between the first and second angular orientations. In particular, the magnetic forces between rotatable magnetic structure 204 and the carrier beads clinging to sleeve 204 are sufficient to cause magnetic structure 204 to rotate in either direction with the rotation of sleeve 206. By limiting the amount by which magnetic structure 204 may freely rotate with sleeve 206, magnetic structure 204 may be positioned at the first angular orientation during forward (clockwise in FIG. 2) rotation of sleeve 206, such as during toner development onto the photoconductive member 110, and at the second angular orientation after a reverse (counterclockwise) rotation of sleeve 206, such as during times when toner development is not desired to occur.

Figure 4:
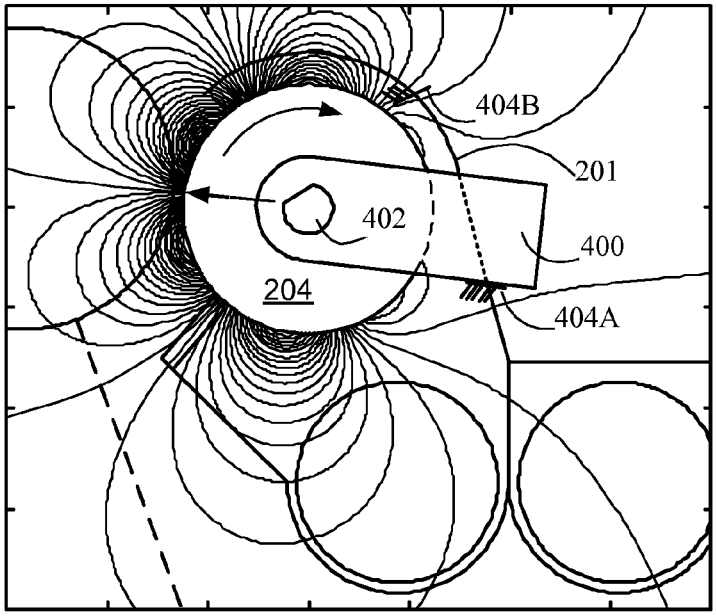
FIGS. 4 and 5 are simplified side views of the developer unit of FIG. 2 during printing and non-printing operations, respectively, showing magnetic fields generated thereby.

Developer unit 104 may utilize a stop mechanism for limiting rotation of magnetic structure 204 between the above-described first and second angular orientations. With respect to FIGS. 4 and 5, which show magnetic structure 204 in the first and second angular orientations, respectively, and also to FIG. 3, developer unit 104 may include an extension member 400 having a first end which is secured to shaft 402 of magnetic structure 204 so as to rotate therewith, and a distal second end. In addition, developer unit 104 may include a pair of stop members 404. Stop members 404 may be positioned along housing 201 of developer unit 104, such as along an inner surface thereof. Stop member 404A may be positioned along housing 201 so as to limit an extent of forward (clockwise in FIG. 4) rotation of magnetic structure 204, and stop member 404B may be positioned along housing 201 so as to limit an extent of reverse (counterclockwise in FIG. 5) rotation of magnetic structure 204. The extent of forward rotation corresponds to the first angular orientation for proper toner development, and the extent of reverse rotation corresponds to the second angular orientation for preventing unwanted toner development. Specifically, as sleeve 206 is rotated in the forward direction, such as during toner development, extension member 400 contacts stop member 404A and is prevented from further rotation, thereby preventing magnetic structure 204 from further forward rotation with sleeve 206. Conversely, as sleeve 206 is rotated in the reverse direction, such as when toner development is not to occur, extension member 400 contacts stop member 404B and is prevented from further rotation, thereby preventing magnetic structure 204 from further reverse rotation with sleeve 206. In this way, magnetic structure 204 may be properly positioned for toner development and when toner is not desired to be developed.

In the above-described example embodiment, the angular distance between the first angular orientation and the second angular orientation may be about half the distance between the magnetic pole associated with toner development and the magnetic pole immediately forward (in a clockwise direction) associated with transport of carrier beads following toner development. For example, the angular distance may be between about 20 degrees and about 40 degrees, and particularly between about 25 degrees and about 35 degrees, such as about 30 degrees.

Instead of stop members 404 being attached along housing 201 of develop unit 104, alternatively stop members 404 may be attached to the frame or the like of image forming device 100. In this case, extension member 400 may extend at least partly externally to housing 201 so as to contact stop members 404.

Figure 5:
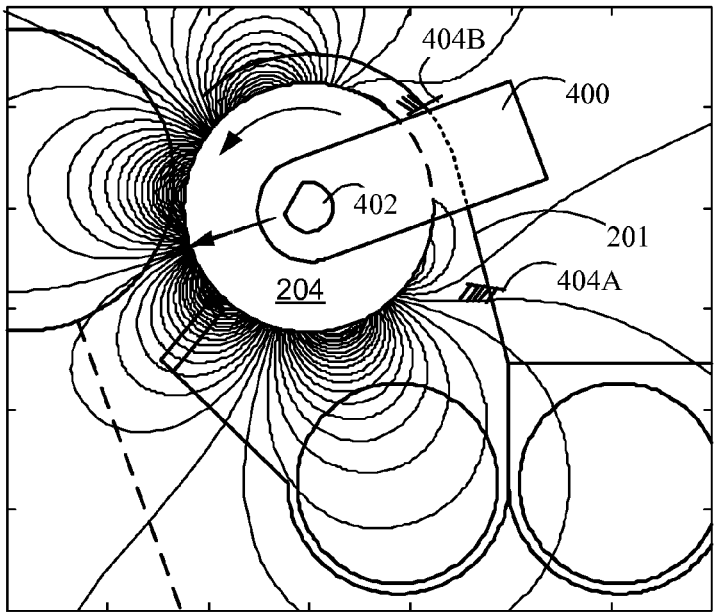

The above-described example embodiments described the use of rotating magnetic structure 204 between the first and second angular orientations. In another example embodiment, magnetic structure 204 is fixed in the first angular orientation and sleeve 206 is rotated in the reverse (counterclockwise, as shown in FIGS. 3 & 5) by an amount during times when toner development is not to occur. In this case, motor 208 rotates sleeve 206 in the reverse direction until there are no carrier beads contacting the photoconductive member 110. In some systems utilizing an ITM, such as ITM 106, the amount of reverse rotation of sleeve 206 may be between about 100 degrees and about 200 degrees, such as about 180 degrees.

The foregoing description of several methods and an embodiment of the invention have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A developer apparatus for an electrophotographic system, comprising:

a housing containing carrier beads;

a magnetic structure at least partly disposed within the housing and generating a magnetic field;

an endless sleeve disposed around and rotatable about the magnetic structure, the endless sleeve extends from the housing, a portion of the endless sleeve extending from the housing forms a developer nip with a photoconductive member when the developer apparatus is operably associated therewith; and a positioning mechanism coupled to the magnetic structure for limiting an angular position of the magnetic structure between a first position in which the magnetic field causes carrier bead chains to stand up and extend outwardly from the portion of the endless sleeve and a second position in which the magnetic field causes the carrier bead chains to lay down and be positioned substantially against the portion of the endless sleeve;

wherein the magnetic structure follows rotation of the endless sleeve from the first position to the second position and from the second position to the first position via attractive forces between the carrier beads disposed on the endless sleeve and the magnetic structure.

2. The developer apparatus of claim 1, wherein the magnetic structure comprises a shaft about which the magnetic structure rotates, and the positioning mechanism prevents rotation of the shaft beyond the first position in a first rotational direction and prevents rotation of the shaft beyond the second position in a second rotational direction.

3. The developer apparatus of claim 2, wherein the positioning mechanism comprises a first member extending from the shaft for rotating therewith, a first stop member disposed along the housing for contacting the first member when the shaft is in the first position while rotating in the first rotational direction, and a second stop member disposed along the housing for contacting the first member when the shaft is in the second position while rotating in the second rotational direction.

4. The developer apparatus of claim 1, wherein the magnetic structure includes a shaft about which the magnetic structure rotates, and the positioning mechanism comprises a drive device coupled to the shaft for controlling rotation thereof.

5. The developer apparatus of claim 1, wherein an angle between the first position and the second position is between about 20 degrees and about 40 degrees.

6. The developer apparatus of claim 1, wherein an angle between the first position and the second position is between about 25 degrees and about 35 degrees.

7. The developer apparatus of claim 1, wherein the magnetic structure, when in the electrophotographic system, is configurable for being placed in the first position during toner development and in the second position during times other than toner development.

8. The developer apparatus of claim 1, wherein the carrier bead chain contacts the photoconductive member when the magnetic structure is in the first position and the developer apparatus is operably associated with the photoconductive member, and lays down such that no carrier beads contact the photoconductive member when the magnetic structure is in the second position and the developer apparatus is operably associated with the photoconductive member.

9. A developer apparatus for an imaging system, comprising:

a housing containing carrier beads;

a magnetic structure at least partly disposed within the housing and generating at least one magnetic field; and an endless sleeve disposed around and rotatable about the magnetic structure, the endless sleeve extending from the housing, a portion of the endless sleeve extending from the housing for forming a developer nip with a photoconductive member when the developer apparatus is operably associated therewith;

wherein the magnetic structure is movable between a first position for developing a magnetic brush of the carrier beads along the portion of the endless sleeve forming the developer nip with the photoconductive member when the developer apparatus is operably associated therewith, and a second position for retracting the magnetic brush along the portion of the sleeve forming the developer nip when the developer apparatus is operably associated with the photoconductive member;

wherein the magnetic structure comprises a shaft about which the magnetic structure is rotatable between the first and second positions;

wherein the developer apparatus further comprises at least one extension member coupled to the shaft of the magnetic structure so as to rotate therewith, a distal region of the at least one extension member being engageable with at least one stop member so as to limit rotation of the shaft beyond at least one of the first and second positions; and wherein the magnetic structure is coupled to the endless sleeve via attractive forces between the magnetic structure and the carrier beads on the endless sleeve such that the magnetic structure is rotatable with the endless sleeve via the attractive forces when the magnetic structure moves from the first position to the second position, and when the magnetic structure moves from the second position to the first position.

10. The developer apparatus of claim 9, wherein the magnetic structure includes a shaft about which the magnetic structure rotates, at least one end of the shaft for coupling to a motion powered device.

11. The developer apparatus of claim 9, wherein the magnetic structure rotates about an axis of rotation, and an amount of rotation of the magnetic structure is between about 10 degrees and about 50 degrees about the axis of rotation.

12. The developer apparatus of 11, wherein the amount of rotation of the magnetic structure is between about 20 degrees and about 40 degrees.

13. An apparatus for an imaging system, comprising:

a housing containing carrier beads;

a magnetic structure at least partly disposed within the housing and generating at least one magnetic field; and an endless sleeve disposed around and rotatable about the magnetic structure, the endless sleeve extending from the housing, a portion of the endless sleeve extending from the housing for forming a developer nip with a photoconductive member when the apparatus is operably associated therewith, the endless sleeve being rotatable by the imaging system in a forward direction during a printing operation and a reverse direction following completion of the printing operation;

wherein the magnetic structure follows rotation of the endless sleeve in both the forward and reverse directions via attractive forces between the carrier beads disposed on the endless sleeve and the magnetic structure.

14. The apparatus of claim 13, wherein the endless sleeve is rotated following completion of the printing operation until a number of carrier beads and toner particles disposed on the portion of the endless sleeve is substantially reduced relative to a number of carrier beads and toner particles disposed on the portion of the endless sleeve during the printing operation.

15. The apparatus of claim 13, wherein the magnetic structure is rotated following completion of the printing operation until magnetic fields of the magnetic structure cause carrier beads and toner particles along the portion of the endless sleeve to be positioned substantially against the endless sleeve.

16. The apparatus of claim 15, wherein the magnetic structure is rotatable about a longitudinal axis, and wherein the apparatus further comprises an extension member having a first end connected to the magnetic structure and a distal second end.

* * * * *